United States Patent [19]

Fulks

[11] Patent Number: 4,854,578

[45] Date of Patent: Aug. 8, 1989

[54] MULTI-PURPOSE EXERCISE MACHINE

[76] Inventor: Kent B. Fulks, 9710 Amberly, Dallas, Tex. 75243

[21] Appl. No.: 226,892

[22] Filed: Aug. 1, 1988

[51] Int. Cl.[4] ..... A63B 21/00

[52] U.S. Cl. ..... 272/134; 272/117

[58] Field of Search ..... 272/117, 118, 123, 134, 272/143, DIG. 4

[56] References Cited

U.S. PATENT DOCUMENTS

| | | | |
|---|---|---|---|
| 2,855,199 | 10/1954 | Noland et al. | 272/117 |
| 3,306,611 | 2/1967 | Gaul | 272/117 |
| 3,640,527 | 2/1972 | Proctor | 272/118 |
| 4,226,415 | 10/1980 | Wright | 272/DIG. 4 X |
| 4,355,633 | 10/1982 | Heilbrun . | |
| 4,405,128 | 9/1983 | McLaughlin et al. | 272/117 |
| 4,422,636 | 12/1983 | De Angeli | 272/117 |
| 4,500,089 | 2/1985 | Jones | 272/118 X |
| 4,502,681 | 3/1985 | Blomqvist | 272/117 X |
| 4,600,189 | 7/1986 | Olschansky et al. | 272/118 |
| 4,621,807 | 11/1986 | Stramer | 272/117 |
| 4,627,614 | 12/1986 | De Angeli | 272/117 |
| 4,666,149 | 5/1987 | Olschansky et al. | 272/134 X |
| 4,711,448 | 12/1987 | Minkow et al. | 272/134 X |
| 4,763,897 | 8/1988 | Yakata | 272/118 |

OTHER PUBLICATIONS

Advertisement by Eagle Fitness Systems, Released in PTO 8/1987.

*Primary Examiner*—Richard J. Apley
*Assistant Examiner*—Robert W. Bahr
*Attorney, Agent, or Firm*—Michael A. O'Neil

[57] ABSTRACT

An exercise machine wherein mechanisms are arranged to work selected muscle groups against an appropriate weight. More particularly, the exercise device includes a support frame, a shaft rotatably mounted to the support frame, a lever arm attached to the shaft for angular positioning thereof, an exercise lever arm, an incrementally adjustable weight system, a movable bench and an adjustably positioned exercise bar which exercise device allows an individual, when used in combination, to perform all of the conventional muscle group exercises required to maintain a fully-rounded fitness program.

10 Claims, 9 Drawing Sheets

27
26
25
20
23c
23b
23a
24
5
100
181
135
134
180
138
137
150
151
153b
153a
6
26
25
20
30
31
140
136
121
162
70
160
71
72
73

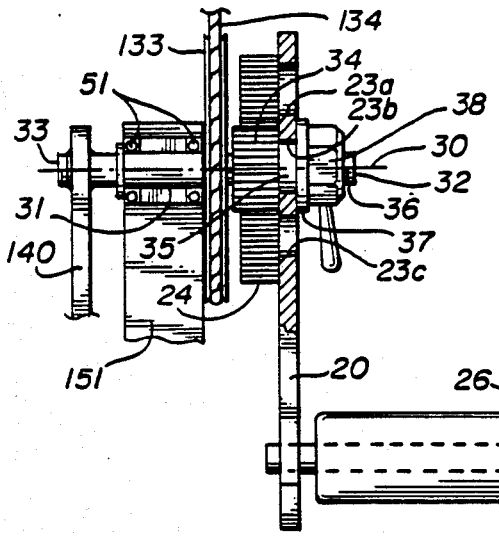
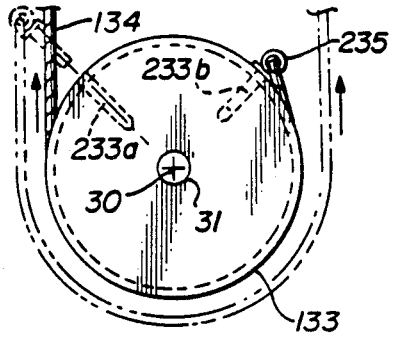
FIG. 7
FIG. 6
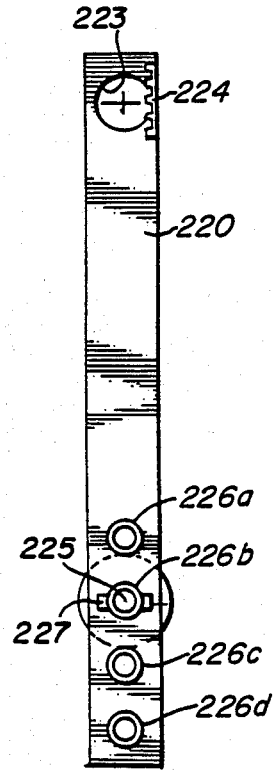
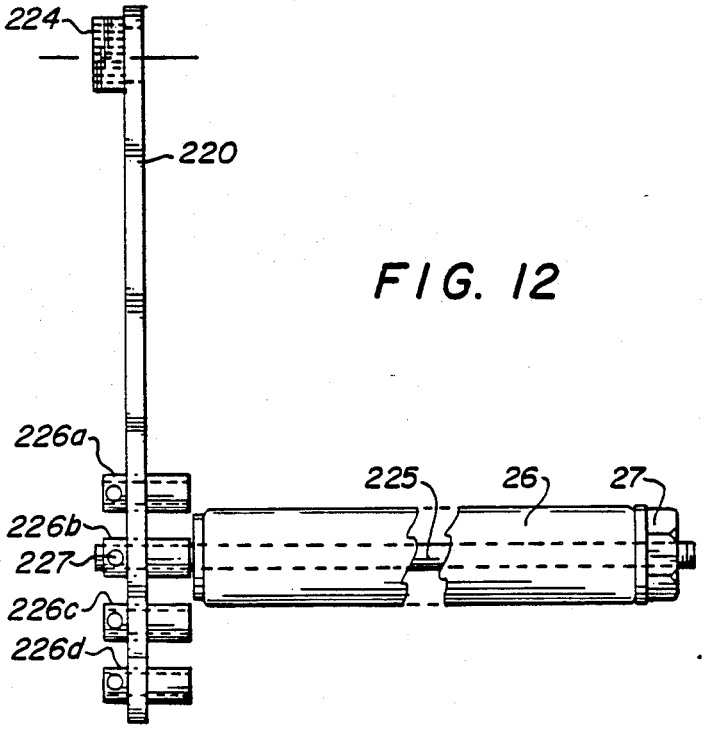
FIG. 12
FIG. 11

MULTI-PURPOSE EXERCISE MACHINE

TECHNICAL FIELD

This invention relates to the field of exercise equipment wherein mechanisms are arranged to work selected muscle groups against an appropriate weight. More particularly, in a single unit, this machine provides means for performing all of the conventional muscle group exercises required to maintain a fully rounded fitness program.

BACKGROUND AND SUMMARY OF THE INVENTION

Physical fitness is recognized as being beneficial to longevity, quality of life and self esteem. As a result, recent years have brought a proliferation of so called "health clubs". One of the main attractions of these health clubs is the availability of a variety of exercise machines, each of which provides means for performance on one, or sometimes two specific exercises. A series of machines of this type are known under the trademark "Nautilus", and typified by the example disclosed in U.S. Pat. No. 3,640,527 to Procter. Each of these machines permit exercising of a selected muscle group against a resisting force derived from appropriately adjustable weights. The exercises are similar to those traditionally performed with free weights with certain beneficial additions and variations. This format as defined by health club machine usage, has become accepted as the conventional exercise format. The user is able to do bench and military presses, arm and leg curls and extensions, pull-overs, rowing lifts, squats, stomach and back exercises, and others. Moreover, in many cases these machines provide a variable mechanical advantage, maximizing the benefit of a weight through the range of movement of a given exercise, as taught by Lambert U.S. Pat. No. 4,200,279. Additionally, the performance of these exercises is much more convenient than with free weights because of the ease with which weight adjustments are made. Changing weights requires only the pulling and reinsertion of a pin, whether for a 10 pound or a 200 pound change. The typical club will have a weight room with perhaps a dozen machines in order to accommodate a complete exercise program.

Health clubs have enjoyed popularity because of the efficacy of their exercise program, the great convenience the offer, and the obvious impracticality of accommodating such a number of machines in the average home. Not only does the space required by such equipment make it unsuitable to home use, but the cost of a complete group of machines is beyond the means of all but the wealthy.

The potential market for a multi-purpose home exercise unit that provides substantially the same benefits as the array of health club machines is obvious, and attempts have been made to address this need. These attempts have generally compromised the conventional exercise format and, as a consequence, their market has been limited. Even if the alternative exercises are readily performed and generally effective, the average user is not willing to accept any significant departure from the familiar conventional exercise routine. An example of such exercising machines is disclosed in U.S. Pat. No. 3,306,611 to Martin Gaul.

The de Angeli U.S. Pat. No. 4,422,636 shows a device that provides a limited capability for the desirable type of exercises. A large mechanical advantage is inherent to this concept, making it necessary to use much more weight than would otherwise be required. De Angeli teaches neither means of adjusting the leverage, i.e. mechanical advantage, of the exercise bars to enhance the machine's usable range nor means to position the user.s body for suitable engagement therewith.

Another example is Noland U.S. Pat. No. 2,855,190 which teaches an exercise device for use in physical therapy. This device is fixedly mounted to one side or the other of an exercise table allowing one leg to be exercised at the time. Although the device has angular and radial adjustment capabilities, no means for supporting the users body in position for other than leg exercises is taught.

The present invention provides the conventional exercise format capability of a typical group of health club machines in one inexpensive unit. An exercise bar that can be located in a number of optional positions through 360 degrees around the rotational center of movement of the exercise is a feature of the invention. This exercise bar also provides a selection of leverage ratios as needed for the various exercises. A movable bench supports the user's body in position to engage the exercise bar suitably for performing the wide variety of exercises in the conventional format.

A preferred embodiment of the invention comprises a shaft mounted at the rotational center of movement having a lever arm adapted to carry a variable weight on one end and a gear with an outward facing hub on the second end. An exercise bar with a plurality of holes spaced along its lever arm, the holes being sized to fit closely on the gear hub, is selectively assembled to the gear hub. A gear rack mounted along the length of the lever arm is positioned so that it closely engages the gear teeth when any of the aforesaid holes are placed over the gear hub. A retaining nut, adapted for hand application, is used to lock the exercise arm in the selected position. Inasmuch as bilateral exercise capability is a basic characteristic of the conventional format, a full width exercise bar is essential. Easy access to the exercise position for the user and simplicity of adjustment recommend a cantilevered exercise bar, attached on one side only, as the Preferred arrangement. Sufficient torsional stiffness is designed into the exercise bar lever arm to accommodate the twisting movement carried through that member. The integral gear rack makes a useful contribution in this regard.

Most exercises are performed through an angle of rotation of 120 degrees or less. It is desirable that the weight lever arm be situated to provide the maximum benefit throughout this range. This is achieved by setting the weight lever arm so that its arc of travel is equally distributed below and above the horizontal. The angular relationship of the exercise lever arm to the weight lever arm is determined by the selected exercise routine and, stops are provided which set the lowermost position of the weight lever arm at the appropriate angle.

An exercise bench is slideably mounted on the frame of the machine allowing it to be positioned adjacent to, or on either side of, the center of rotation. Thus, the user's body can be positioned optimally for a wide variety of torso, arm and leg exercises.

With the exercise bar positioned at 5:00 o'clock, the weight arm at approximately 4:00 o'clock, and the bench to the left with its end adjacent to the center of rotation, the user can sit on the end of the bench, facing to the right. The user can then engage the exercise bar with the ankles thus doing leg extensions. With the same angular relationships, and a shorter exercise bar lever arm, the user, positioned as before , can lean forward, grasp the exercise bar with his hands, and do arm curls. With the exercise arm rotated to 3:00 o'clock, the weight arm still at 4:00 o'clock, and the bench moved about a foot to the right, the user can lie face down on the bench and do leg curls. Now, with the weight still at 4:00 and the exercise arm rotated to 1:00, the user can sit on the floor, facing left with his elbows at the center of rotation, and do arm extensions. In a similar manner, the optional arrangements of the invention allow a great variety of exercises to be performed.

The bench can even be positioned transversely and located so that the user can lie on his hack with his shoulder at the center of rotation for chest contractions, one side at the time.

In addition to the conventional exercise format as described above, a more expensive embodiment of the invention can also provide the health club machine s convenient "pull pin and reinsert" weight selection. This embodiment employs the same general cable and sheave arrangement as do the health club machines but, here again, the invention reduces the need to only one machine.

DESCRIPTION OF THE DRAWINGS

A more complete understanding of the invention may be had by reference to the following Detailed Description of the Invention when taken in conjunction with the accompanying Drawings, wherein:

FIG. 6 is a sectional view taken from FIG. 4 along the line 6—6.

FIG. 7 is a partial view of the rotating shaft and sheave of FIG. 4.

FIG. 11 is a side view of an alternate exercise arm for use with the embodiment of either FIG. 1 or FIG. 4.

FIG. 12 is a view of the exercise arm of FIG. 11 taken in the direction of the arrows.

DETAILED DESCRIPTION OF THE INVENTION

Figure 1:
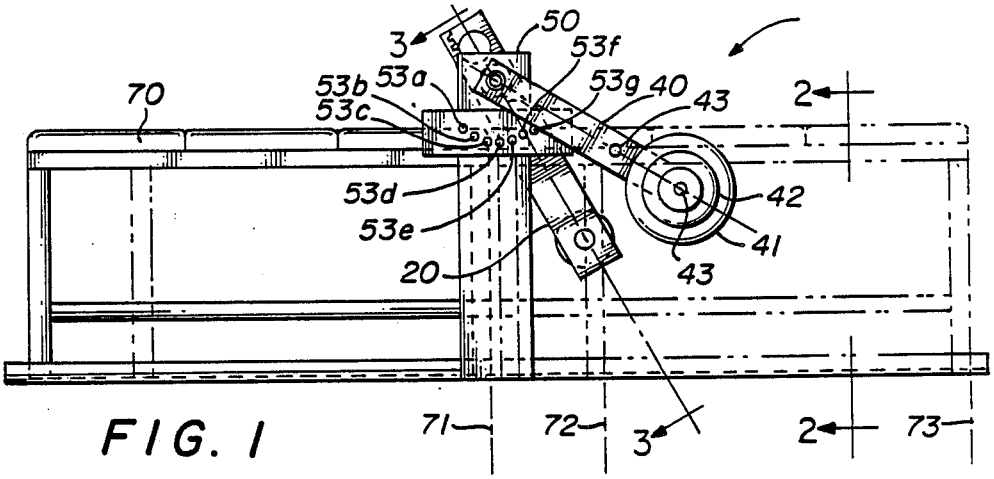
FIG. 1 is a side view of an exercise machine incorporating the first preferred embodiment of the invention.
Figure 2:
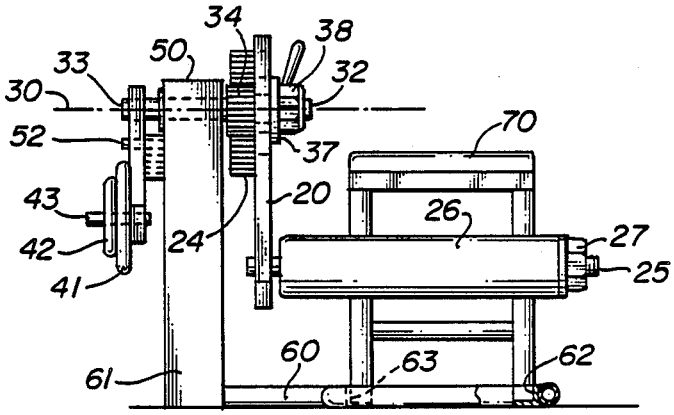
FIG. 2 is an end view of the first preferred embodiment as shown in FIG. 1, taken in the direction of the arrows 2—2.
Figure 3:
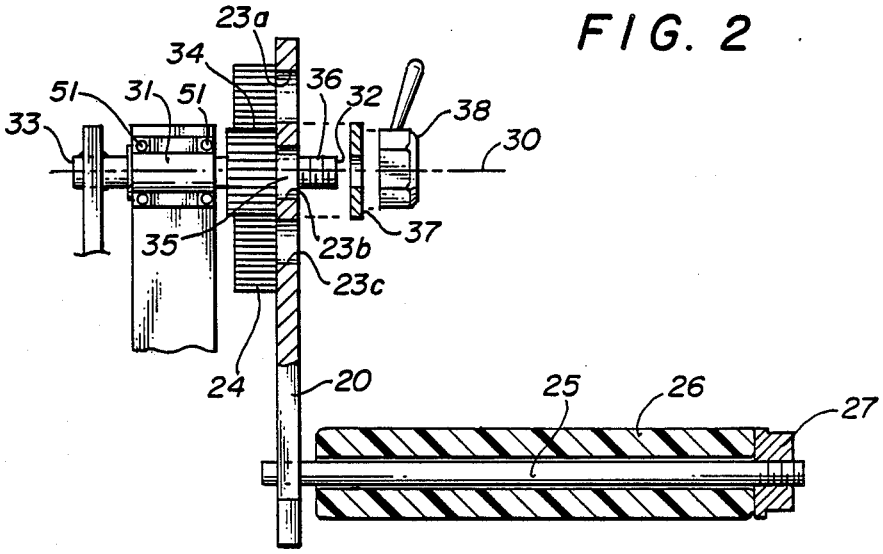
FIG. 3 is a sectional view taken along the line 3—3 in FIG. 1, in the direction of the arrows.

Referring now to the Drawings, and particularly to FIGS. 1, 2, and 3 thereof, there is shown an exercising machine 10 incorporating the present invention. A vertical column 50 is fixed to side 61 of base 60. A shaft 31 is rotatably mounted in bearings 51 which define the center of rotation 30 at the upper end of said column 50. Said shaft 31 has a first end 32 and a second end 33. A weight lever arm 40 is attached to the first shaft end 32. Weights of various sizes, 41 and 42, are placed on the weight pins 43. The second shaft end 33 comprises a gear 34 having an outwardly facing hub 35 of reduced diameter and an extended threaded portion 36. Holes 23*a*, 23*b*, and 23*c* in exercise lever arm 20 are sized to fit onto the reduced diameter hub 35 with minimal clearance. A gear rack 24 fixed to the exercise lever arm 20 engages the gear 34 when one of the holes 23 is fitted onto the hub 34, thus fixing the exercise lever arm 20 and the weight lever arm 40 in a selected angular relationship. A washer 37 and a hand tightened clamping nut 38 provide means for locking the exercise lever arm 20 in place. A full width, cantilevered exercise bar 25 is transversely mounted at the outer end of the exercise lever arm 20 and accommodates various attachments retained by the flanged nut 27. A padded roller 26 is one such attachment used for those torso and leg exercises in which the hands do not grasp the bar. The cantilevered exercise bar 25 allows the user easy access to the machine. The resting position of the weight lever arm 40 is selected to best meet the requirements of a given exercise routine by setting stop pin 52 in a an appropriate stop hole 53*a*, 53*b*, 53*c*, 53*d*, 53*f* or 3*g*. A track consisting of bench support sections 62 and 63 provides locating means for a range of positions for the exercise bench 70 as indicated by the broken lines 71, 72, and 3, so that the users body can be supported in an appropriate position for any of the conventional exercises.

Figures 4, 9, 10:
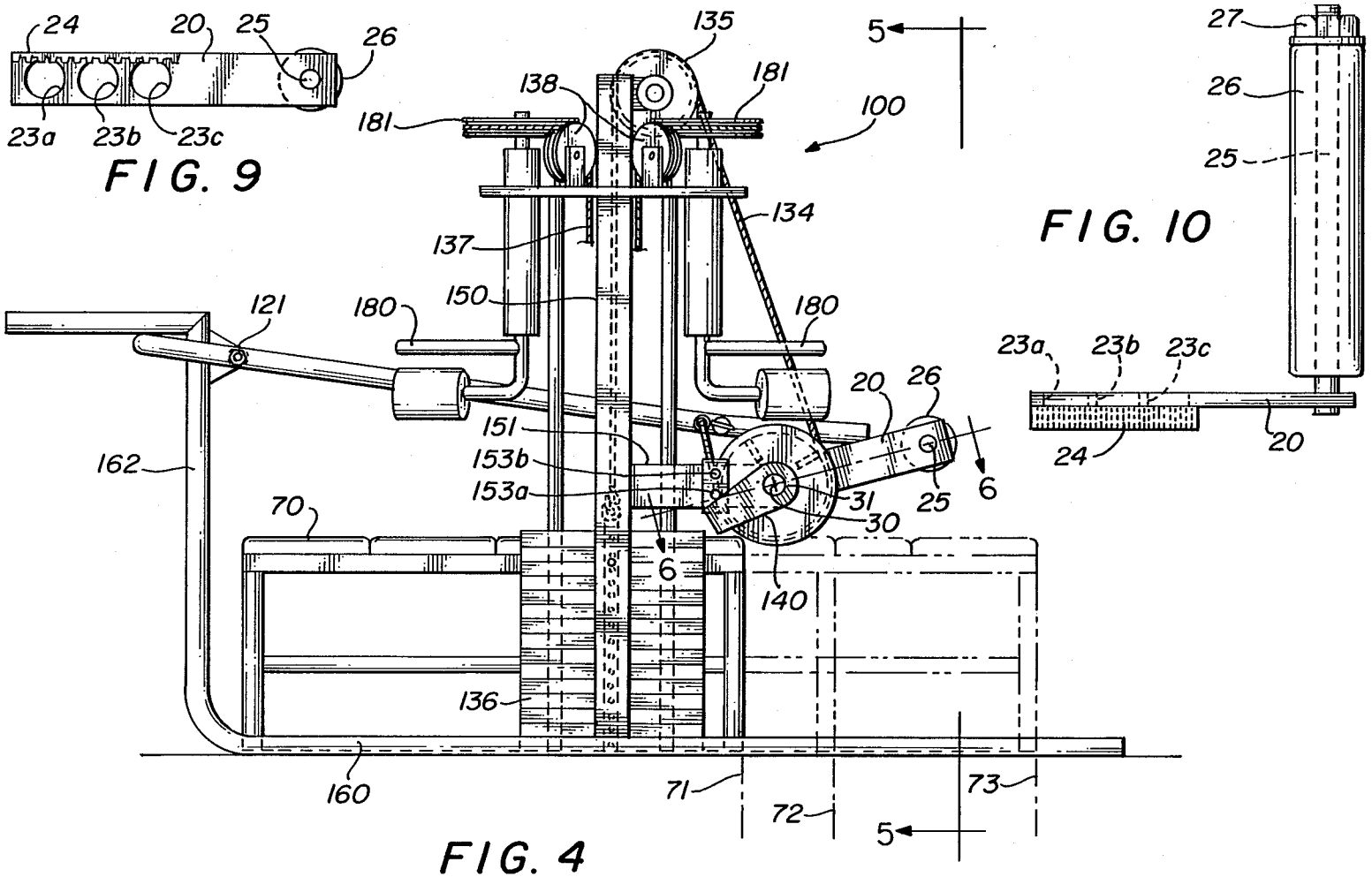
FIG. 4 is a side view of a second embodiment of the present invention.
FIG. 9 is a side view of the exercise arm of the embodiment of either FIG. 1 or FIG. 4.
FIG. 10 is a view of FIG. 9 taken in the direction of the arrows.
Figure 5:
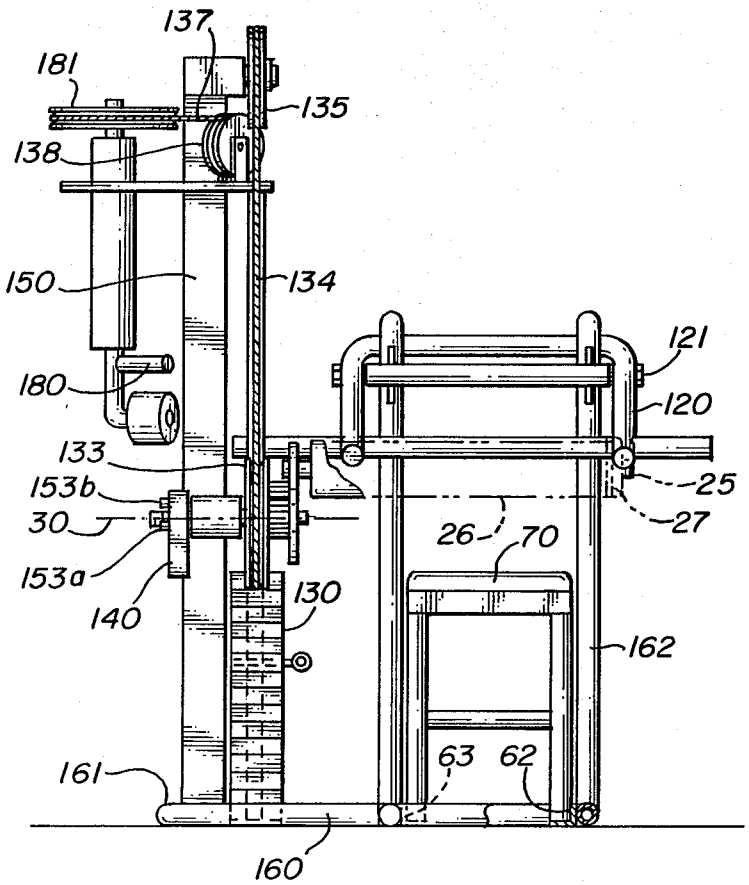
FIG. 5 is an end view of the second embodiment as shown in FIG. 4 taken in the direction of the arrows 5—5.

Referring now to FIGS. 4, 5, and 6, there is shown a second exercising machine 100 incorporating the present invention. In this embodiment a vertical column 150 is fixed to side 161 of base from 160 and a horizontal member 151 extends from the column 150. The shaft 31 is rotatably mounted in bearings 51 which define the center of rotation 30 at the outer end of said horizontal member 151, said shaft 31 having a first end 32 and a second end 33. A sheave 133 which receives the first weight system cable 134 is mounted on rotating shaft 31. A positioning lever arm 140 is attached to the second shaft end 32. The first shaft end 33 carries the sheave 133 inwardly adjacent to the gear 34 with the outwardly facing hub 35 of reduced diameter, and an extended threaded portion 36. A first weight system cable 134 is shown going around sheave 133 and idler sheave 135 to the weight stack 136. In this view cable 134 is connected to an alternate exercise lever arm 120 used for press type exercises. The alternate exercise lever arm 120 is pivotally attached on axis 121 to the upright portion 162 of the base frame 160. The holes 23*a* 23*b*, and 23*c* in the exercise lever arm 20 are each sized to fit on the reduced diameter hub 35 with minimal clearance. The gear rack 24 fixed to the exercise lever arm 20 engages the gear 34 when one of the holes 23 is fitted onto the gear hub 35, thus fixing the exercise lever arm 20 and the positioning lever arm 140 in a selected angular relationship. The washer 37 and the hand tightened clamping nut 38 provides means for locking the exercise lever arm 20 in place. The full width, cantilevered exercise bar 25 is transversely mounted at the outer end of the exercise lever arm 20 and accommodates various attachments retained by the flanged nut 27. The padded roller 26 is one such attachment used for those torso and leg exercises in which the hands do not grasp the bar. The cantilevered exercise bar 25 allows the user easy access to the machine. The stop position of the positioning lever arm 140 is set to hold the exercise lever arm 20 at its starting position without slack in the cable 134. The resting location of the positioning lever arm is selected by setting stop pin 152 in the appropriate stop hole 153*a* or 153*b*. A track consisting of bench support sections 62 and 63 provides locating means for a range of positions for the exercise bench 70 as indicated by the broken lines 71, 72 and 73, so that the users body can be supported in an appropriate position for any of the conventional exercises.

A second weight system cable 137 passing over idler sheaves 138 and equalizing sheave assembly 139 which may be attached to the weight stack 136. The ends of said cable are secured to sheaves 181 and thereby to lever arms 180 for chest contraction exercises.

FIG. 7 shows the sheave 133, having alternate radial pin receiving holes 233*a* and 233*b* at or near the groove centerline, mounted on rotating shaft 31. The first weight system cable 134 ending with connecting pin 235 is shown received by sheave 133 in a counter-clockwise sense as with connecting pin 235 inserted in pin receiving hole 233*b*. The alternate clockwise method of connection of cable 134 to sheave 133 is accompanying with the insertion of connecting pin 235 in receiving hole 233*a*. In this manner, either a clockwise or a counter-clockwise movement may be imparted to the rotating shaft 31.

Figure 8:
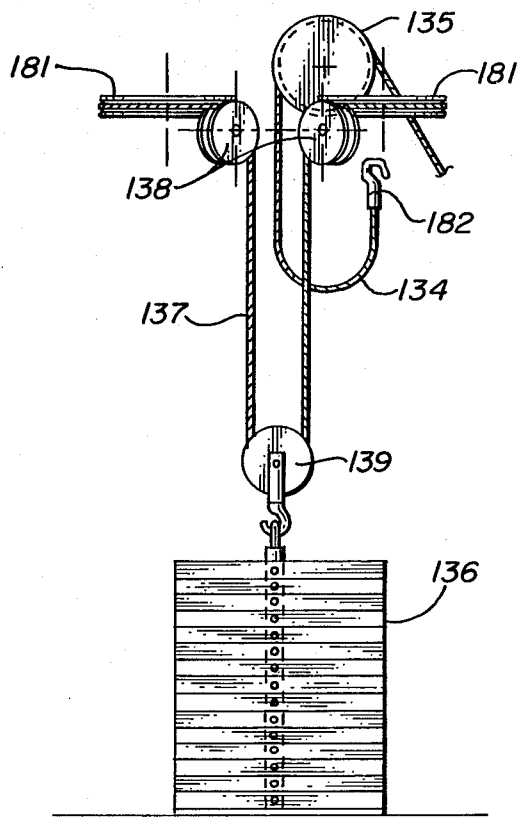
FIG. 8 is a partial view of the weight system of FIG. 4.

FIG. 8 shows the second weight system cable 137 connected by means of equalizer sheave assembly 139 to weight stack 136. Said cable 137 then passes over idler sheaves 138 and ends in connections to the sheaves 181. In this manner, the system is configured for chest contraction exercises. Disengagement of the hook end of equalizer sheave assembly 139 from the weight stack 136 and connection of the hook end 182 of the first weight system cable 134 configures the system for all other exercises.

FIG. 9 shows the exercise lever arm 20 of FIGS. 1 and 4, with the alternate fitting holes 23*a*, 23*b*, and 23*c* providing optional working radii of the exercise bar 25. The gear rack section 24 provides engagement means (with gear 34) at each said fitting hole. The exercise bar 25 is shown with the padded roller 26 in assembly therewith.

In FIG. 10, there is shown the relationship of the gear rack section 24 to the body of the exercise lever arm 20 and the fitting holes 23*a*, 23*b* and 23*c*, which provide optional working radii for exercise bar 25.

FIG. 11 shows an alternate exercise arm 220, wherein a single fitting hole 223 with a short locking tooth rack section 224 adjacent thereto is employed. A plurality of exercise bar fitting sockets 226*a*, 226*b*, 226*c*, and 226*d* provide for optional working radii of the exercise bar 225. The exercise bar 225 is retained in the selected location by keeper pin 227.

In FIG. 12 the manner of engagement of the exercise bar 225 with one of the alternate fitting sockets 226*b* of the exercise arm 220 is shown. The exercise bar 225 is retained in the socket 226*b* by pin 227 and is shown with the padded roller 26 held in assembly by flanged nut 27.

Figure 13:
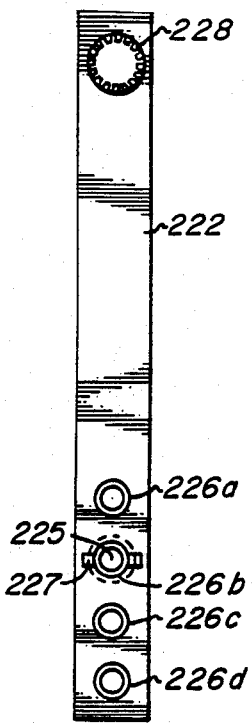
FIG. 13 is a side view of a second alternate exercise arm for use with the embodiment of either FIG. 1 or FIG. 4.

FIG. 13 shows a second alternate exercise lever arm 222 wherein the single fitting hole comprises an internal gear 228 adapted for engagement (with gear 34) at any selected position. A plurality of exercise bar fitting sockets 226*a*, 226*b*, 226*c* and 226*d* for optional working radii of the exercise bar 225 which is retained in the selected socket by pin 227.

Figure 14:
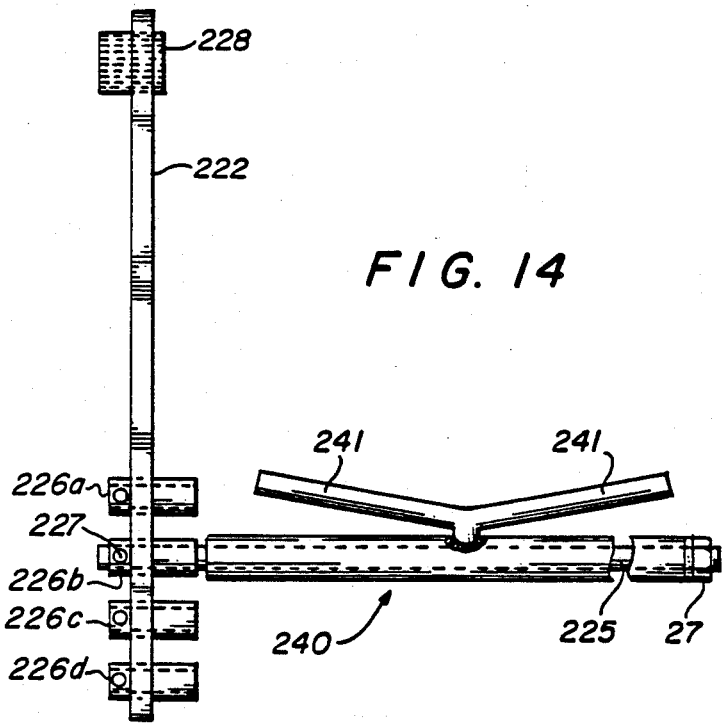
FIG. 14 is a view showing the exercise arm of FIG. 13 taken in the direction of the arrows.

In FIG. 14 the manner of engagement of the exercise bar 225 with one of the alternate fitting sockets 226*b* of the exercise lever arm 222 is shown. The exercise bar 225 is retained in the socket 226*b* by pin 227. An alternate attachment 240 with inclined handle bars 241 for rowing exercises and the like is fitted over exercise bar 225 and retained with flanged nut 27.

Figure 15:
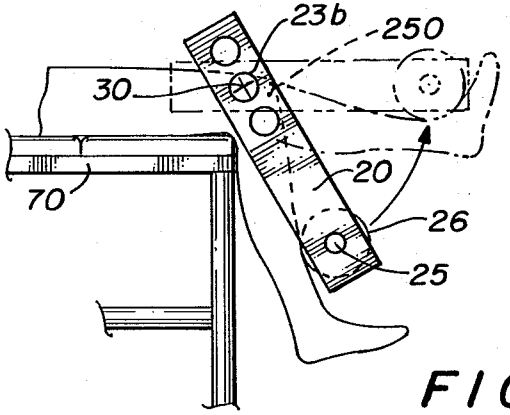
FIG. 15 is a partial view showing the invention as it is used to perform leg extension exercises.

FIG. 15 is a partial view of the invention as it is used to perform leg extension exercises. The angular range of the exercise is shown to be approximately 60 degrees, therefor the most effective use of a weight lever arm would require it to be in an initial position of 30 degrees below horizontal for counter-clockwise motion which, referring to FIG. 1, would be equivalent to a stop pin 52 setting in hole 53*f*. The exercise bar 25 with the roller 26 is set at an intermediate radius about the center of rotation 30 by connection at fitting hole 23*b*, and the bench 70 is positioned adjacent to the rotational center 30, placing the user's knee 250 in alignment therewith.

Figure 16:
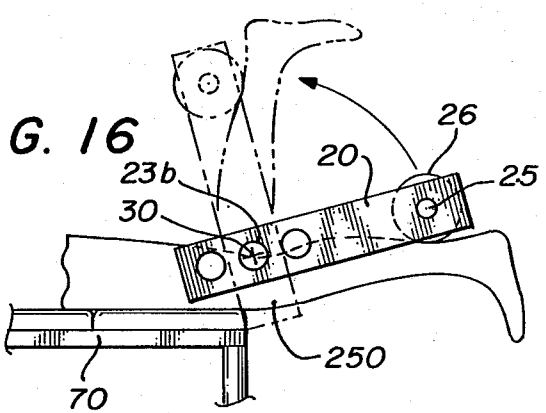
FIG. 16 is a partial view showing the invention as it is used to perform leg curl exercises.

FIG. 16 is a partial view of the invention as it is used to perform leg curl exercises. The angular range of the exercise is shown to be approximately 90 degrees, therefore the most effective use of a weight lever arm would require it to be in an initial position of 45 degrees below horizontal for counter-clockwise motion which, referring to FIG. 1, would be equivalent to a stop pin 52 setting at hole 53*e*. The exercise bar 25 with the roller 26 is set at an intermediate radius about the center of rotation 30 by connection at fitting hole 23*b* and the bench 70 is positioned alongside the rotational center 30, supporting the user's torso and upper leg so that the user's knee 250 is in alignment therewith.

Figure 17:
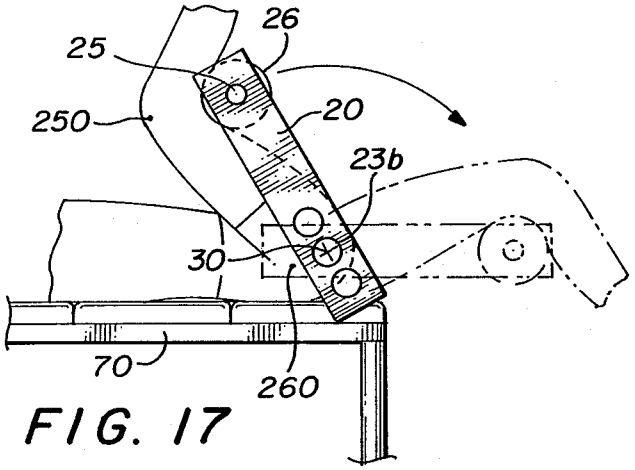
FIG. 17 is a partial view showing the invention as it is used to perform hip flexion exercises.

FIG. 17 is a partial view of the invention as used to perform hip flexion exercises. The angular range of the exercise is shown to be approximately 120 degrees, therefore the most effective use of a weight lever arm would require it to be in an initial position of 60 degrees below horizontal for clockwise motion which, referring to FIG. 1, would be equivalent to a stop pin 52 setting at hole 53*d*. The exercise bar 25 with the roller 26 is set at an intermediate radius about the center of rotation 30 by connection at fitting hole 23*b*, and the bench 70 is positioned alongside the rotational center 30, supporting the user's torso so that the hip joint 260 is placed in alignment therewith.

Figure 18:
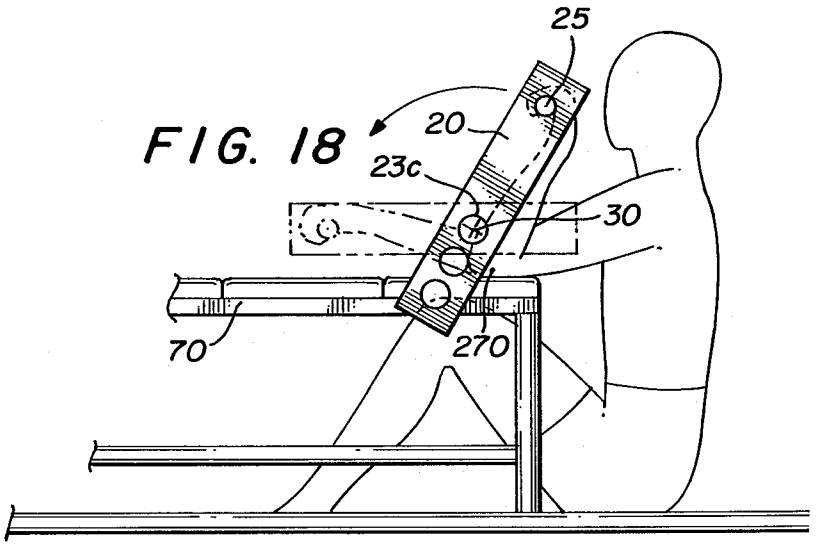
FIG. 18 is a partial view showing the invention as it is used to perform arm extension exercises.

FIG. 18 is a partial view of the invention as it is used to perform arm extension exercises. The angular range of the exercise is shown to be approximately 120 degrees, therefore the most effective use of a weight lever arm would require it to be in an initial position of 60 degrees below horizontal for counter-clockwise motion which, referring to FIG. 1, would be equivalent to a stop pin 52 setting at hole 53*d*. The exercise bar 25 is set at a relatively short radius about the center of rotation 30 by connection at fitting hole 23*c* and the bench 70 is positioned alongside the rotational center 30, supporting the user's upper arm so that the elbow 270 is placed in alignment therewith.

Figure 19:
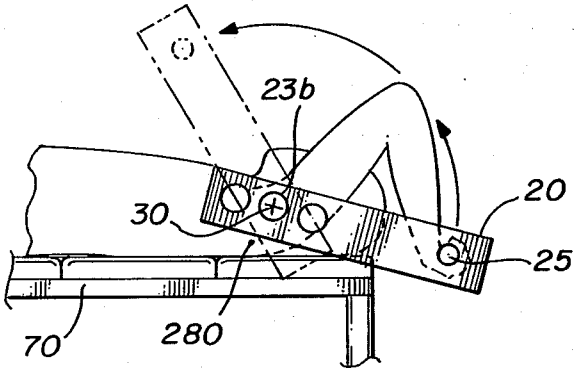
FIG. 19 is a partial view showing the invention as it is used to perform arm pullover exercises.

FIG. 19 is a partial view of the invention as it is used to perform arm pullover exercises. The angular range of the exercise is shown to be approximately 120 degrees, therefore the most effective use of a weight lever arm would require it to be in an initial position of 60 degrees below horizontal for counter-clockwise motion which, referring to FIG. 1, would be equivalent to a stop pin 52 setting at hole 53*d*. The exercise bar 25 is set at an intermediate radius about the center of rotation 30 by connection at fitting hole 23*b*, and the bench 70 is positioned alongside the rotational center 30, supporting the user's torso so that the shoulder 280 is placed in alignment therewith.

Figure 20:
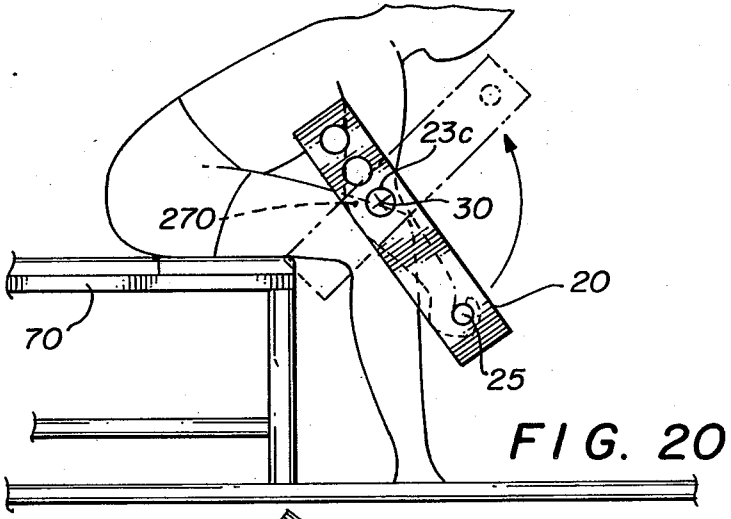
FIG. 20 is a partial view showing the invention as it is used to perform arm curl exercises.

FIG. 20 is a partial view of the invention as it is used to perform arm curl exercises. The angular range of the exercise is shown to be approximately 120 degrees, therefore the most effective use of a weight lever arm would require it to be in an initial position of 60 degrees below horizontal for counter-clockwise motion which, referring to FIG. 1, would be equivalent to a stop pin 52 setting at hole 53*d*. The exercise bar 25 is set at a relatively short radius about the center of rotation 30 by connection at fitting hole 23*c* and the bench 70 is positioned so that the user can sit with elbows 270 in alignment with the rotational center 30.

Figure 21:
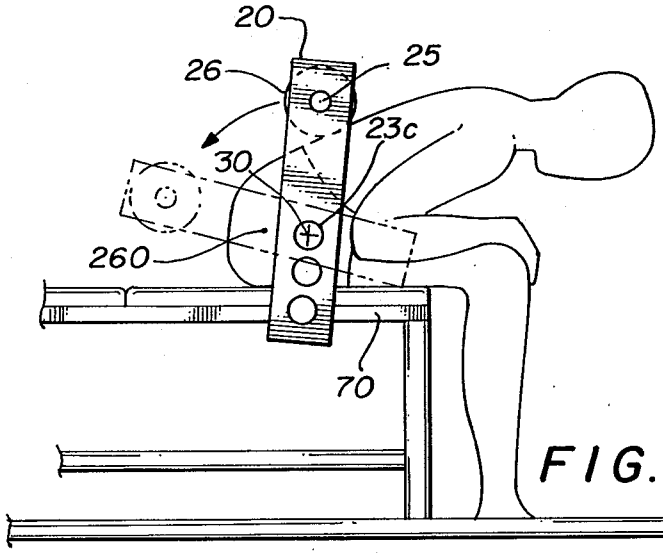
FIG. 21 is a partial view showing the invention as it is used to perform back extension exercises.

FIG. 21 is a partial view of the invention as it is used to perform back extension exercises. The angular range of the exercise is shown to be approximately 60 degrees, therefore the most effective use of a weight lever arm would require it to be in an initial position of 30 degrees below horizontal for counter-clockwise motion which, referring to FIG. 1, would be equivalent to a stop pin 52 setting at hole 53*f*. The exercise bar 25 is set at a relatively short radius about the center of rotation 30 by connection at fitting hole 23*c* and the bench 70 is positioned alongside the rotational center 30 so that the user can sit with the hip joint 260 in alignment therewith. The padded roller attachment 26 is placed on the exercise bar 25 for the user's comfort.

Figure 22:
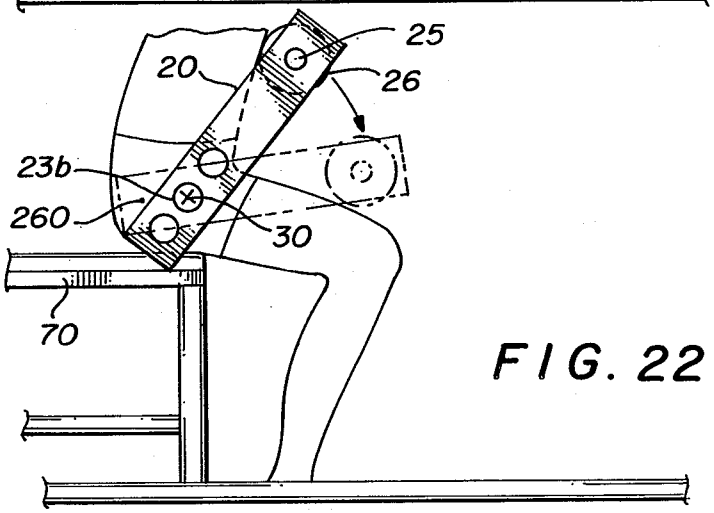
FIG. 22 is a partial view showing the invention as it is used to perform stomach contraction exercises.

FIG. 22 is a partial view of the invention as it is used to perform stomach contraction exercises. The angular range of the exercise is shown to be approximately 60 degrees, therefore the most effective use of a weight lever arm would require it to be in an initial position of 30 degrees below horizontal for clockwise motion which, referring to FIG. 1, would be equivalent to a stop pin 52 setting at hole 53*b*. The exercise bar 25 is set at a relatively short radius about the center of rotation 30 by connection at fitting hole 23*c* and the bench 70 is positioned alongside the rotational center 30 so that the user can sit with the hip joint 260 in alignment therewith. The padded roller attachment 26 is placed on the exercise bar 25 for the user's comfort.

Figure 23:
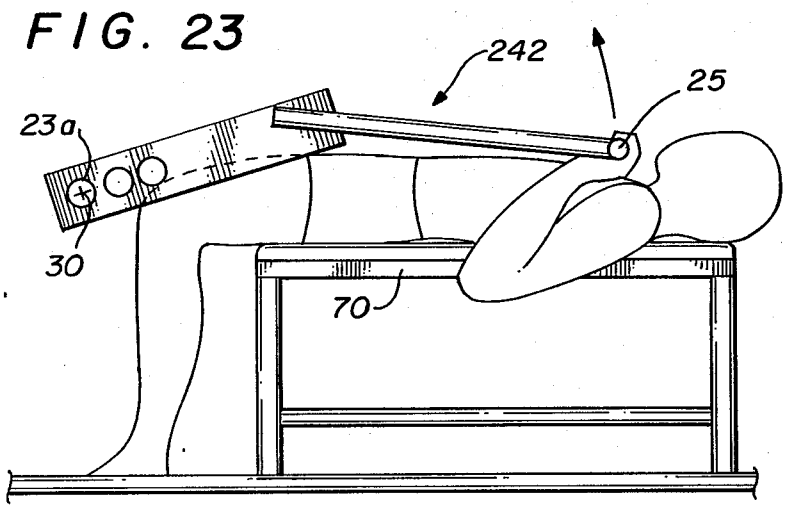
FIG. 23 is a partial view showing the invention as it is used to perform bench press exercises.

FIG. 23 is a partial view of the invention as used to perform bench press exercises. The angular range of the exercise is shown to be approximately 30 degrees, therefore the most effective use of a weight lever arm would require it to be in an initial position of 15 degrees below horizontal for counter-clockwise motion which, referring to FIG. 1, would be equivalent to a stop pin 52 setting at hole 53*g*. The exercise bar is set at an extended radial position about the center of rotation 30 by connection at fitting hole 23*a* and the bench 70 is positioned so as to support the user's torso placing the shoulders and hands at the exercise bar 25. The press type exercises are of a group that do not require joint juxtaposition with the center of rotation 30.

Figure 24:
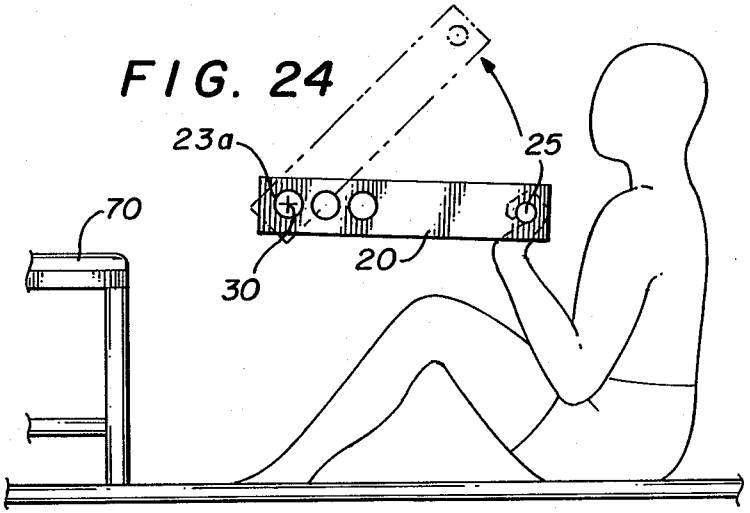
FIG. 24 is a partial view showing the invention as it is used to perform military press exercises.

FIG. 24 is a partial view of the invention as it is used to perform military press exercises. The angular range of the exercise is shown to be approximately 30 degrees, therefore the most effective use of a weight lever arm would require it to be in an initial position of 15 degrees below horizontal for counter-clockwise motion which, referring to FIG. 1, would be equivalent to a stop pin 52 setting at hole 53*g*. The exercise bar is set at an extended radial position about the center of rotation 30 by connection at fitting hole 23*c*. Again, the press type exercises are of a group that do not require joint juxtaposition with the center of rotation 30. The bench 70 is positioned out of the way so that the user can sit on the floor with the shoulders and hands placed at the exercise bar 25.

Figure 25:
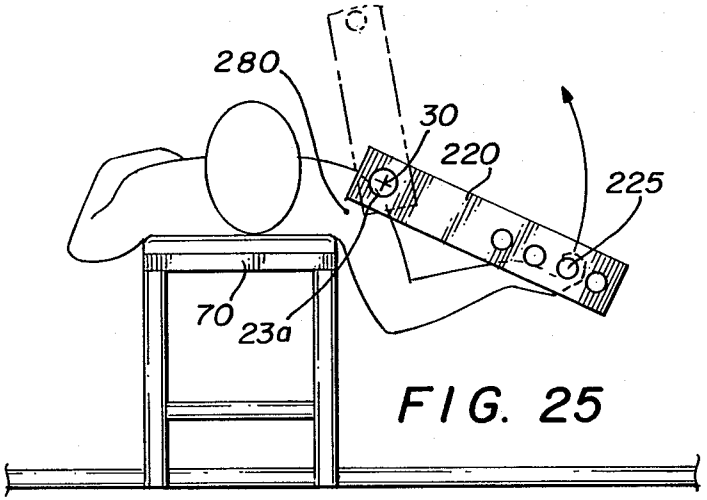
FIG. 25 is a partial view showing the invention as it is used to perform chest contraction exercises.

FIG. 25 is a partial view of the invention as it is used to perform chest contraction exercises. The angular range of the exercise is shown to be approximately 120 degrees, therefore the most effective use of a weight lever arm would require it to be in an initial position of 60 degrees below horizontal for counter-clockwise motion which, referring to FIG. 1, would be equivalent to a stop pin 52 setting at hole 53*d*. The exercise bar 25 is set at a relatively short radial position about the center of rotation by connection at fitting hole 23*c* and the bench 70 is positioned parallel to, and alongside of, the center of rotation 30. In this manner, the user's torso is supported, back down, with the shoulder 280 in alignment with the rotational center 30 with the active arm in position for the exercise.

Figure 26:
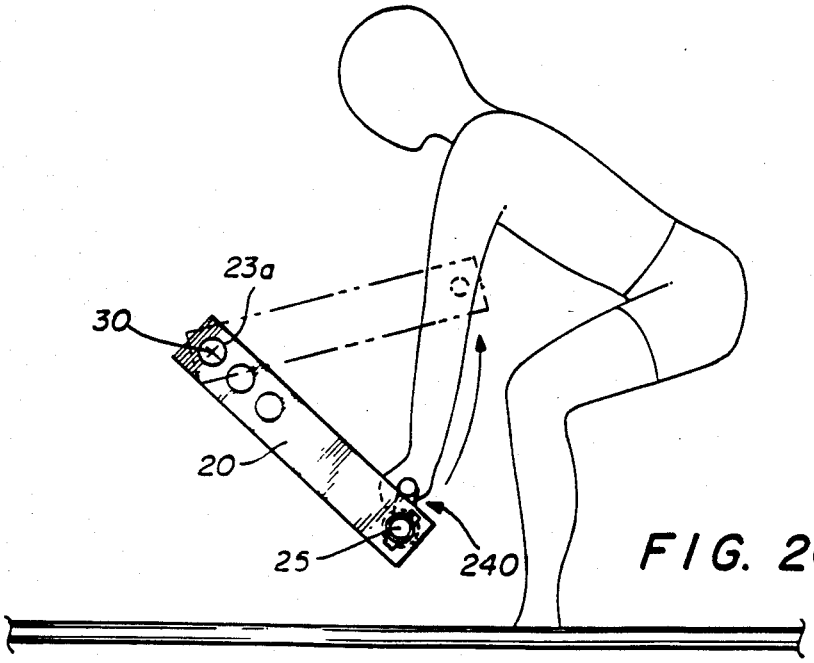
FIG. 26 is a partial view showing the invention as it is used to perform rowing motion exercises.

FIG. 26 is a partial view of the invention as used to perform rowing exercises. The angular range of the exercise is shown to be approximately 60 degrees, therefore the most effective use of a weight lever arm would require it to be in an initial position of 30 degrees below horizontal for counter-clockwise motion which, referring to FIG. 1, would be equivalent to a stop pin 52 setting at hole 53*f*. The exercise bar is set at an extended radial position about the center of rotation 30 by connection at fitting hole 23*a* and, alternate attachment 240 is fitted over the exercise bar 25. This exercise does not require joint juxtaposition with the center of rotation 30, therefore, the bench 70 is positioned out of the way so as not to interfere with the user.

Figure 27:
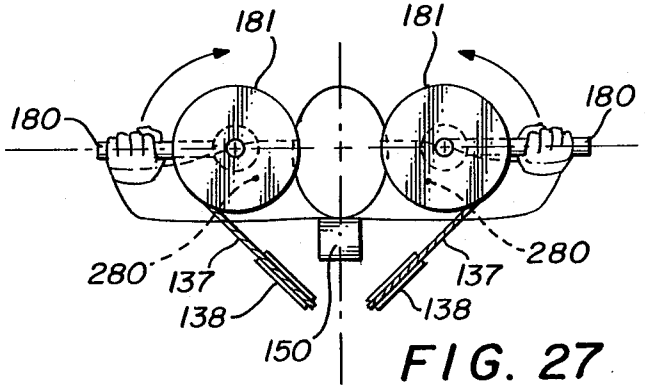
FIG. 27 is a partial view, taken from above, of the embodiment of FIGS. 4, 5, and 8, as it is used to perform chest contraction exercises.

FIG. 27 is a partial view, taken from above, of the manner in which the mechanism of FIGS. 4, 5, and 8 is used to perform chest contraction exercises. It is understood that the second weight cable 37 is engaged with the weight stack 136 by means of equalizing sheave assembly 139, as is shown in FIG. 8, for this exercise. The cable 137 passes over idler sheaves 138 and each end of said cable is connected to one of the sheaves 181. The user's back is placed against the vertical column 150 with the shoulders 280 positioned beneath the sheaves 181 so that the lever arms 180 may be readily grasped. The user may squat to assume this position or sit the an appropriately repositioned bench 70.

Figure 28:
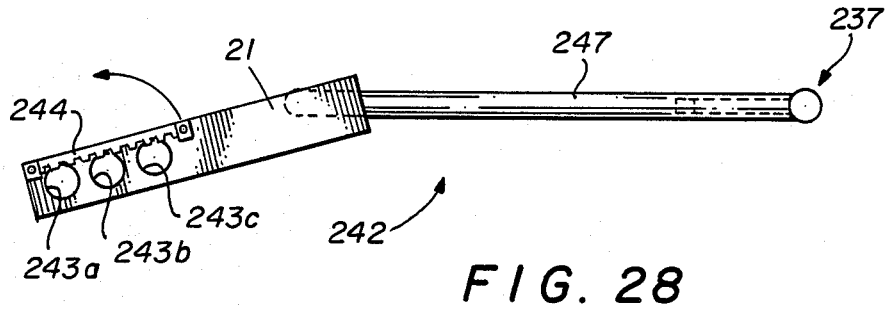
FIG. 28 is a side view of an alternate exercise arm of the type shown being used in FIG. 23.
Figure 29:
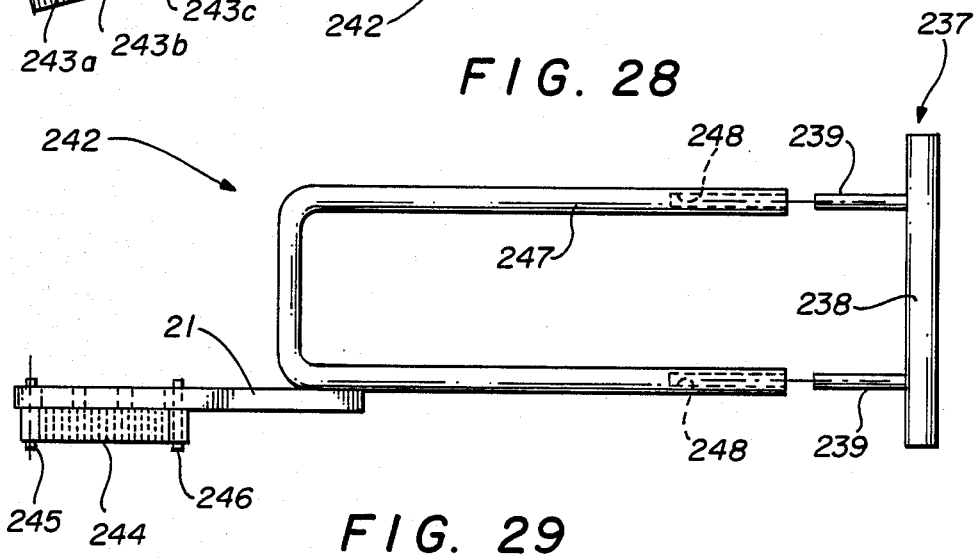
FIG. 29 is a plan view of the exercise arm shown in FIG. 28.

In FIGS. 28 and 29, another alternate exercise lever arm 242 is shown. This exercise lever arm is particularly adapted to the group of exercises that do not require joint juxtaposition with the center of rotation 30 as is typified by the press exercise of FIG. 23 and hence could also be used for the exercises shown in FIGS. 24 and 26. The "U" shaped handle bars 247 are joined to the exercise lever arm plate 21 at a slight obtuse angle in order to provide working clearance for the user as shown in FIG. 23. The exercise lever arm plate 21 is provided with alternate fitting holes 243*a*, 243*b*, and 243*c* for assembly as shown in FIGS. 3 or 6. Rack section 244 is hinged on pin 245 and held in place by pin 246. This allows hinged movement of the rack section 244 for angular positioning of the arm 242 without its removal. An end attachment 237 used for squat exercises and the like, is comprised of cross bar 238 and fitting pieces 239. The fitting pieces 239 are adapted for insertion in the open ends 248 of the handle bar 247 allowing the end attachment 237 to be removed when not needed.

Figure 30:
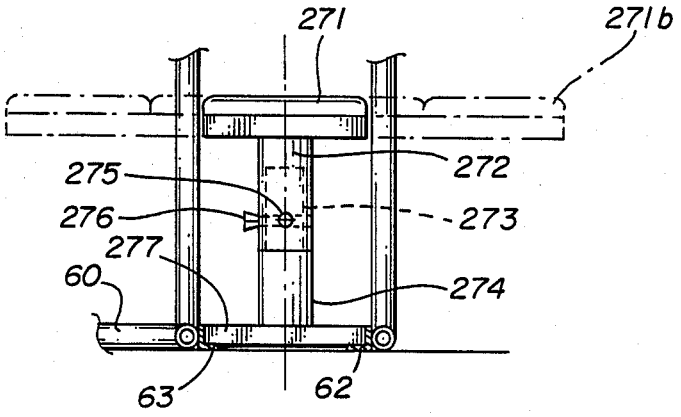
FIG. 30 is a partial end view, showing an alternate bench as it would be if taken in the direction of arrows 2—2 in FIG. 1.

FIG. 30 shows an alternate exercise bench 271 as it would be if used with the embodiment of FIG. 4, but it can also be used with that of FIG. 1. The base 277 fits into the track consisting of bench support sections 62 and 63. A tubular pedestal 274 with an upper section 273 of reduced diameter is fixed centrally atop the base 277 and a tubular member 272 fits freely on the diameter of section 273 so that it is supported by the larger diameter of the pedestal 274. The exercise bench 271 is symmetrically mounted atop tubular member 272. Holes 275 are cross-drilled through both member 272 and section 273 in matched locations which allows pin 276 to fix the bench 271 in either the position shown or in the alternate position 271*b*.

USE OF THE INVENTION

The typical workout exercise group will vary according to individual need and preference but will generally include a combination of leg, torso and arm routines. A frequent user will combine exercises of similar weight lever arm settings and weight amounts in a manner that minimizes machine set-up changes in an individualized manner.

A given user might begin with the machine set up as shown in FIG. 18 for arm extension exercises using some suitable amount of weight on the weight lever arm. Since this is an exercise with a counter-clockwise movement range of about 120 degrees, the weight lever arm positioning pin will be set for a starting position of 60 degrees below horizontal. After completing this exercise the user might then elect to do a set of pullover exercises as shown in FIG. 19. This will not entail any change in the weight lever arm setting since it is also a 120 degree, counter-clockwise movement, but the user may elect to add some increment of weight. The exercise lever arm will then be removed and reset slightly below the 3:00 o'clock position on the intermediate radius itting hole. The bench is then relocated to suit the user, and the machine is set up for the pullover exercise.

Next, the user might want to do leg curls as shown in FIG. 16 This is also a counter-clockwise movement, but of only about 90 degrees, so the user raises the starting position of the weight lever arm to the next higher pin setting or 45 degrees below horizontal. This also rotates the exercise lever arm up from the FIG. 19 position to a setting slightly above the 3:00 o'clock position as shown in FIG. 16. Now, with the weight suitably adjusted, and the bench location adjusted, the user is ready to do leg curls.

The next exercise desired may be leg extensions as shown in FIG. 17. This is a clockwise exercise movement of about 120 degrees thus both the exercise lever arm and the weight lever arm are repositioned. To do this, the exercise lever arm is first taken off, then the weight lever arm is rotated up over the top and lowered to 60 degrees below horizontal on the opposite side, against the relocated positioning pin. If need be the weights may be taken off to facilitate this change. Now, the exercise lever arm is refitted at an 11:00 o'clock position, again on the intermediate radius setting. With a suitable amount of weight on the weight lever arm and the bench suitably located, the machine is set up for leg extension exercises.

In a like manner, the machine is configured for any of a great variety of exercises as may be suited to the needs of the individual user, including but not limited to those shown in this disclosure.

Although preferred embodiments of the invention have been illustrated in the Drawings and described in the foregoing specification, it will be understood that the invention is not limited to the embodiments disclosed, but is capable of rearrangement, modification, and substitution of parts and elements without departing from the spirit of the invention.

I claim:

1. An adjustable exercise arm arrangement for use with a multiple purpose exercise machine comprising;

a support frame;

a shaft rotatably mounted on said support frame, said shaft having first and second ends;

a gear with a reduced diameter hub fixed to said shaft with said hub at or near said first end thereof;

an exercise lever arm having proximal and distal ends wherein an exercise bar having a plurality of hub fitting holes is fixedly attached at or near said distal end in a substantially perpendicular relationship to said exercise lever arm;

said plurality of hub fitting holes having bore axes parallel to said exercise bar, each said hole being located near said proximal end at a different distance from said exercise bar; and, tooth fitting means integral to said exercise arm adapted for engaging at lease one tooth of said gear when any said hub fitting hole is placed over said hub.

2. An exercise machine adapted to a plurality of exercise modes comprising:

a support frame;

a shaft having first and second ends, said shaft being rotatably mounted to said frame about a center of rotation;

a lever arm fixed to the second end of said rotatably mounted shaft for angular positioning thereof;

one or more removable pin stops on said support frame which thereby limit rotation of said positioning lever at a selected angle;

an exercise lever arm;

a gear fixed to said rotatably mounted shaft at or near the first end thereof;

means for fitting said exercise lever arm over said first shaft end;

tooth fitting means integral to said exercise lever arm which engage at least one tooth of said gear at a plurality of optional positions;

an exercise bar transversely attached to said exercise lever arm near the distal end thereof;

a plurality of engagement means, said plurality of engagement means providing optional radii of movement of said exercise bar about said center of rotation;

an incrementally adjustable weight system;

means for connecting said weight system whereby a movement about said center of rotation is applied to said exercise lever arm; and moveable bench means for providing alternate positions of support whereby the users knee, hip, elbow or shoulder joints may be juxtaposed to said center of rotation.

3. An exercise machine in accordance with claim 1 wherein the weight system further comprises:

a plurality of flat, elongated weight elements adapted for additive engagement;

a flexible tension element attached to said weight elements;

a sheave mounted to said rotatable shaft on said center of rotation; and connecting means whereby said tension element may engage said sheave in either a clockwise or a counter-clockwise sense and attach thereto.

4. An exercise machine in accordance with claim 1 wherein the weight system further comprises:

a weight lever arm fixed to said rotatable center shaft; and means for attachment of a selected combination of weights to said weight lever arm.

5. An exercise machine in accordance with claim 4 wherein said weight lever arm also functions as the positioning lever arm.

6. An exercise machine in accordance with claim 2 wherein said movable bench means comprises:

a base supported by frame members allowing freedom of movement in a direction substantially perpendicular to the axis of said center of rotation;

a pedestal fixed atop said base; and an exercise bench supported by and rotatably mounted on said pedestal, said pedestal being adapted for locking said bench either substantially perpendicular or substantially parallel to the axis of said center of rotation.

7. An exercise machine adapted to a plurality of exercise modes comprising:

a support frame;

a shaft having first and second ends, said shaft being rotatably mounted to said frame about a center of rotation;

a lever arm fixed to the second end of said rotatably mounted shaft for angular positioning thereof;

one or more removable pin stops on said support frame which thereby limit rotation of said positioning lever at a selected angle;

an exercise lever arm;

a gear fixed to said rotatably mounted shaft at or near the first end thereof;

means for fitting said exercise lever arm over said first shaft end;

tooth fitting means integral to said exercise lever arm which engage at least one tooth of said gear at a plurality of optional positions;

an exercise bar transversely attached to said exercise lever arm near the distal end thereof;

a plurality of engagement means, said plurality of engagement means providing optional radii of movement of said exercise bar about said center of rotation;

a plurality of flat, elongated weight elements adapted for additive engagement;

a flexible tension element attached to said weight elements;

a sheave mounted to said rotatable shaft on said center of rotation;

connecting means whereby said tension element may engage said sheave in either a clockwise or a counter-clockwise sense and attach thereto;

means for connecting said weight elements whereby a movement about said center of rotation is applied to said exercise lever arm; and moveable bench means for providing alternate positions of support whereby the users knee, hip, elbow or shoulder joints may be juxtaposed to said center of rotation.

8. An exercise machine in accordance with claim 7 wherein said moveable bench means comprises:

a base supported by frame members allowing freedom of movement in a direction substantially perpendicular to the axis of said center of rotation;

a pedestal fixed atop said base; and an exercise bench supported by and rotatably mounted on said pedestal, said pedestal being adapted for locking said bench either substantially perpendicular or substantially parallel to the axis of said center of rotation.

9. An exercise machine adapted to a plurality of exercise modes comprising:

a support frame;

a shaft having first and second ends, said shaft being rotatably mounted to said frame about a center of rotation;

a lever arm fixed to the second end of said rotatably mounted shaft for angular positioning thereof;

one or more removable pin stops on said support frame which thereby limit rotation of said positioning lever at a selected angle;

an exercise lever arm;

a gear fixed to said rotatably mounted shaft at or near the first end thereof;

means for fitting said exercise lever arm over said first shaft end;

tooth fitting means integral to said exercise lever arm which engage at least one tooth of said gear at a plurality of optional positions;

an exercise bar transversely attached to said exercise lever arm near the distal end thereof;

a plurality of engagement means, said plurality of engagement means providing optional radii of movement of said exercise bar about said center of rotation;

a weight lever arm fixed to said rotatable center shaft;

means for attachment of selected combination of weights to said weight lever arm;

means for connecting said combination of weights and weight lever arm whereby a movement about said center of rotation is applied to said exercise lever arm; and movable bench means for providing alternate positions of support whereby the user,s knee, hip, elbow or shoulder joints may be juxtaposed to said center of rotation.

10. An exercise machine in accordance with claim 9 wherein said moveable bench means comprises:

a base supported by frame members allowing freedom of movement in a direction substantially perpendicular to the axis of said center of rotation;

a pedestal fixed atop said base; and an exercise bench supported by and rotatably mounted on said pedestal, said pedestal being adapted for locking said bench either substantially perpendicular or substantially parallel to the axis of said center of rotation.

* * * * *

UNITED STATES PATENT AND TRADEMARK OFFICE

CERTIFICATE OF CORRECTION

PATENT NO. : 4,854,578

DATED : Aug. 8, 1989

INVENTOR(S) : Kent B. Fulks

It is certified that error appears in the above-identified patent and that said Letters Patent is hereby corrected as shown below:

Column 1, line 23, "by the" should be --by one--.

Column 1, line 49, "the offer" should be --they offer--.

Column 3, line 22, "machine s" should be --machine's--.

Column 4, line 68, "3," should be --73,--.

Column 10, line 8, "itting" should be --fitting--.

Column 11, line 28, "users" should be --user's--.

Column 11, line 32, "Claim 1" should be --Claim 2--.

Column 11, line 43, "Claim 1" should be --Claim 2--.

Column 12, line 34, "users" should be --user's--.

Column 13, line 14, "user,s" should be --user's--.

Signed and Sealed this

Thirty-first Day of July, 1990

*Attest:*

HARRY F. MANBECK, JR.

*Attesting Officer*

*Commissioner of Patents and Trademarks*